US007154450B2

(12) United States Patent
Wolfenden

(10) Patent No.: US 7,154,450 B2
(45) Date of Patent: Dec. 26, 2006

(54) DUAL BAND FEED WINDOW

(75) Inventor: Neil Wolfenden, Bracknell (GB)

(73) Assignee: Andrew Corporation, Westchester, IL (US)

( * ) Notice: Subject to any disclaimer, the term of this patent is extended or adjusted under 35 U.S.C. 154(b) by 43 days.

(21) Appl. No.: 10/907,322

(22) Filed: Mar. 29, 2005

(65) Prior Publication Data

US 2006/0181473 A1 Aug. 17, 2006

Related U.S. Application Data

(63) Continuation-in-part of application No. 10/906,273, filed on Feb. 11, 2005.

(51) Int. Cl.
*H01Q 1/42* (2006.01)
*H01Q 13/00* (2006.01)

(52) U.S. Cl. ..... 343/872; 343/786; 343/784

(58) Field of Classification Search ..... 343/872, 343/786, 772, 840, 784
See application file for complete search history.

(56) References Cited

U.S. PATENT DOCUMENTS 5,576,721 A 11/1996 Hwang et al.
5,625,365 A * 4/1997 Tom et al. ..... 343/700 MS
5,767,815 A * 6/1998 Krebs ..... 343/786
6,166,704 A 12/2000 Jan et al.
6,323,822 B1 11/2001 Cook et al.
6,445,361 B1 9/2002 Liu et al.
6,664,933 B1 12/2003 Spirtus
7,030,831 B1 * 4/2006 Nilsson ..... 343/840
2002/0005806 A1 1/2002 Perrott et al.
2002/0008669 A1 1/2002 Mulhauser et al.
2002/0018016 A1 2/2002 Radonic
2003/0068980 A1 4/2003 Nakagawa et al.
2004/0036661 A1 * 2/2004 Hanlin et al. ..... 343/786

* cited by examiner

*Primary Examiner*—Hoanganh Le
(74) *Attorney, Agent, or Firm*—Babcock IP, PLLC

(57) ABSTRACT

A feed window for a feed assembly having at least one primary feed operating at a primary frequency band and at least one secondary feed operating at a secondary frequency band. The feed window sealing against the feed assembly, enclosing an open end of the feeds. A feed window surface of the feed window supported by and spaced away from the feed assembly by a feed window wall. The feed window surface of the feed window generally parallel to a launch edge of the feeds. The feed window may include an insert positioned between the feed window surface and the feeds. An insert aperture may be applied to the insert, corresponding to a feed view window of one of the feeds.

14 Claims, 3 Drawing Sheets

DUAL BAND FEED WINDOW

CROSS REFERENCE TO RELATED APPLICATIONS

This application is a continuation-in-part of U.S. patent application Ser. No. 10/906,273 titled "Multiple Beam Feed Assembly", filed 11 Feb. 2005 by Andrew Baird and Neil Wolfenden, owned by Andrew Corporation as is the present application, hereby incorporated by reference in the entirety.

BACKGROUND

The open end of a, for example, reflector antenna feed assembly is typically protected from environmental fouling and or degradation by a dielectric feed window. To minimize signal degradation resulting from signal reflections upon the feed window surface, the feed window surface may be positioned one quarter wavelength or other multiple of the mid-band operating frequency wavelength from a launch edge of the feed.

Multiple feeds of differing operating frequency bands may be applied to a common main reflector for simultaneous multiple band operation with closely spaced remote signal sources such as equatorial communications satellites. Previously, each of the multiple feeds was supplied with a dedicated feed window positioned to optimize performance with the operating frequency of each feed. Currently, there is a growing demand for multiple feeds of different operating bands aligned with increasingly narrow beam separation angle(s). These narrow beam separation angles make it difficult to array individual feed assemblies and corresponding feed windows that are not interfering with adjacent signal beams.

The increasing competition for reflector antennas adapted for high volume consumer applications such as VSAT, satellite tv and or internet communications has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

As shown in FIGS. 1–4, the present invention is demonstrated with respect to a feed assembly 10 having multiple feed Ka (18.3–20.2 GHz) and Ku (12.2–12.7 GHz) dual band operation. One skilled in the art will recognize that the invention is similarly applicable to any embodiment having at least one primary feed operating in a primary frequency band (here the Ku band feed) and at least one secondary feed operating in a secondary frequency band (here the two Ka band feed(s)). The number of feeds and their respective operating frequency bands may be selected as desired, the open end of the feed(s) environmentally sealed by a common feed window.

Figure 1:
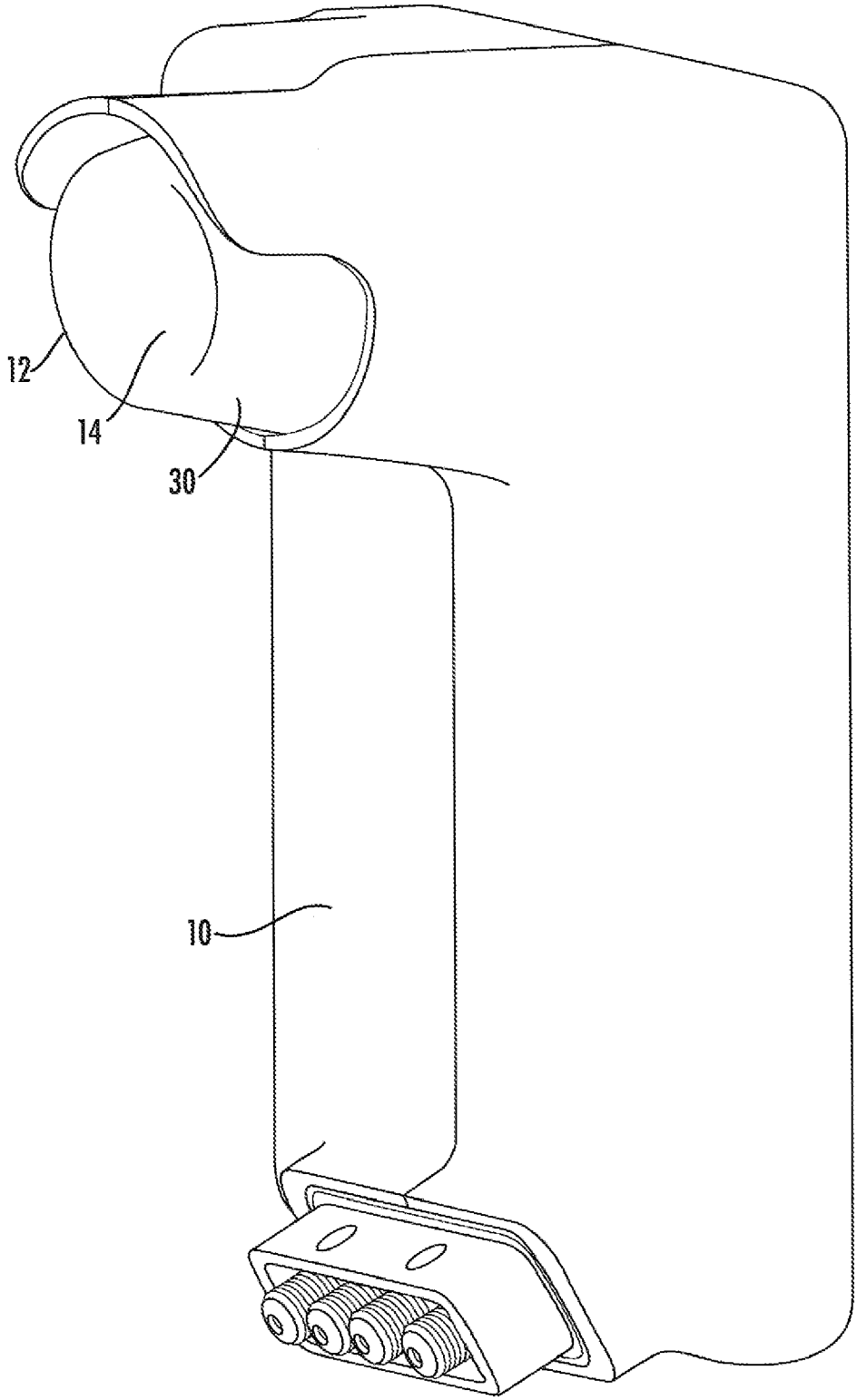
FIG. 1 is a schematic isometric external view of an exemplary embodiment of a feed window according of the invention, shown applied to a dual band triple feed LNBF assembly.
Figure 2:
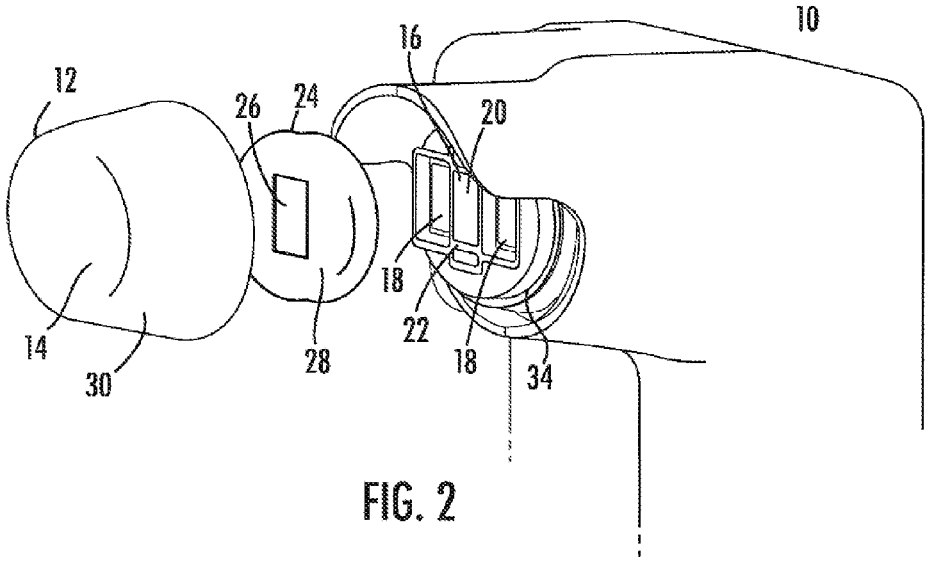
FIG. 2 is an isometric schematic exploded close-up end view of a feed window and insert according to the invention.

A feed window 12 having a feed window surface 14 is adapted to environmentally seal open end(s) 16 of multiple feed(s). As best shown in FIG. 2, the present feed assembly 10 has three adjacent feeds: two Ka band feed(s) 18 each positioned on either side of a Ku band feed 20. Each of the feeds receives circularly polarized signals.

The feed window has an impact on the return loss and cross polar performance of the system which is a function of the window thickness, dielectric properties and frequency. For a given window thickness, return loss is poorer at higher frequencies. With a single window, the window thickness is typically minimized to allow optimum performance. Other design considerations such as mechanical strength and manufacturability issues generally limit the minimum thickness to greater than 0.5 mm which introduces a significant performance degradation.

At a desired operating frequency band, such as the lower Ku band frequency, it is possible to tune the window position to optimize return loss and cross polar performance and largely negate performance degradation resulting from the presence of the feed window surface. The optimum position is generally chosen as that which gives best cross polar performance. Reflections from the window are used to cancel cross polar contributions from other elements of the system. Typically this is optimized by measuring (or simulating) the port to port isolation between the two receive ports and varying the window position until a minimum is found.

Another technique is to use dual window surfaces, spacing the dual window surfaces apart by approximately one quarter wavelength such that the reflections from the two windows cancel. However, for dual band operation, the required tuning of the feed window surface position relative to a launch edge of the feed and or application and spacing of a dual feed window surface would require a compromise between the respective optimum positions calculated for each of the different frequency bands.

Figure 3:
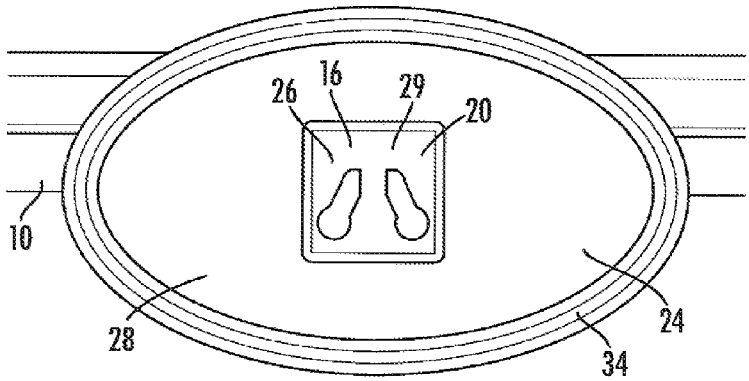
FIG. 3 is a schematic front view of an insert in position relative to a feed assembly, demonstrating insert aperture alignment with a feed view window.
Figure 4:
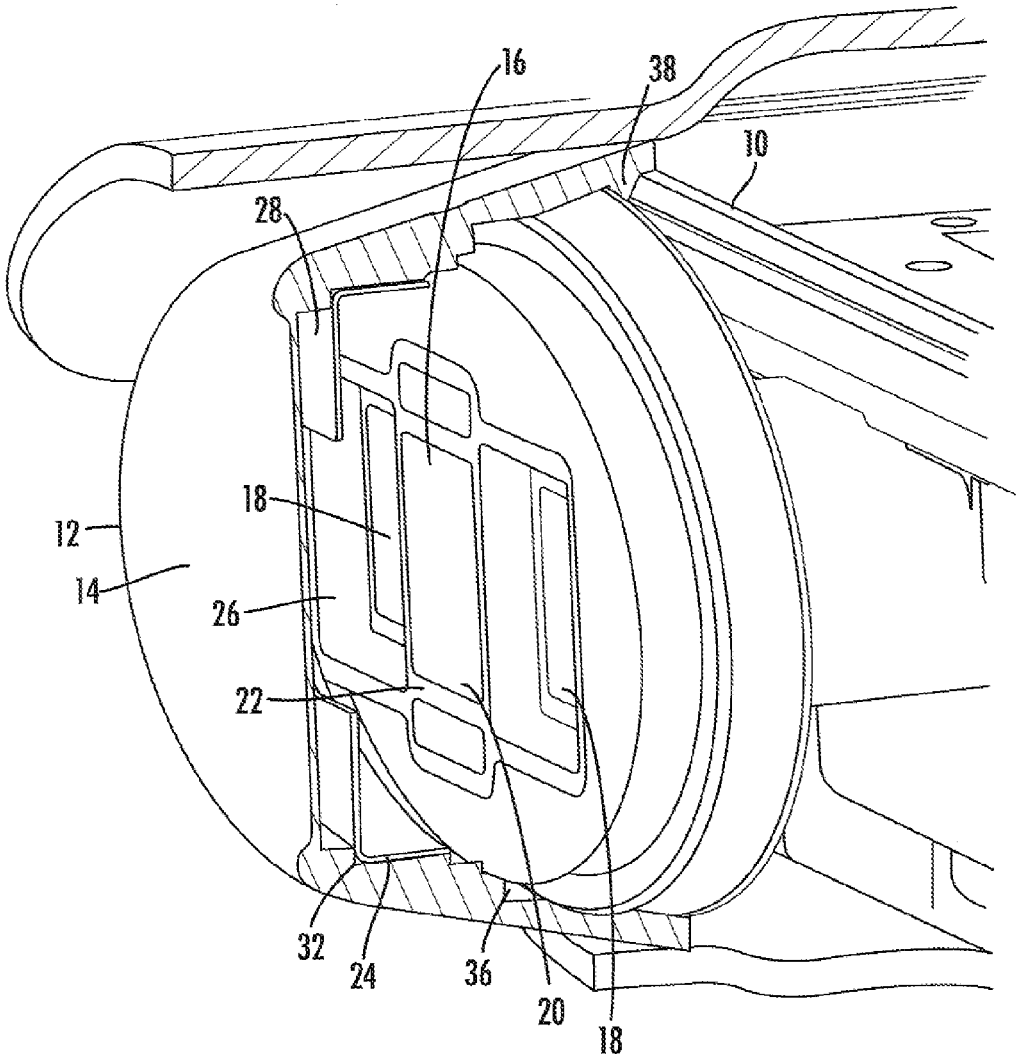
FIG. 4 is a close-up partial cut-away view of FIG. 1.

As shown in FIG. 2, the present invention combines these two techniques so that a single feed window 12 may be applied to multiple feeds operating in different frequency bands. First, the feed window surface 14 is located at an optimized position with respect to a launch edge 22 of the primary feed, here for the Ku band feed 20 which is the lower frequency band. Second, an inner window insert 24 is applied with an inner window insert surface 28 spaced away from the feed window surface 14 a distance optimized with respect to the secondary feed, the Ka band feed 18, such as one quarter wavelength of the Ka mid-band frequency. The inner window insert surface 28 has an aperture 26 formed in the Ku band feed view window 29, as shown in FIG. 3, such that it has minimal performance impact with respect to the Ku band feed 20.

The feed window surface 14 is supported spaced away from the feed assembly 10 by a feed window wall 30. The feed window wall 30 has a shoulder 32 that seats and retains the inner window insert 24 at the desired distance from the feed window surface 14.

Alternatively, the inner window insert surface 28 may be adapted to have multiple levels corresponding to different dampening positions of different frequency bands via formation of a step corresponding to the, for example, Ku band feed view window 29. However, depending upon the closeness of the beam alignment of the different feeds the sidewall of the step may be a significant source of interfering signal reflections that causes greater signal degradation than accepting the Ku band feed window surface signal reflection without an insert for dampening of reflections from the feed window surface 14.

A feed window 12 according to the invention presents a single sealing surface 34 against the feed assembly 10. The environmental seal along the sealing surface 34 may be further improved by the application of a groove 36 and gasket such as an o-ring (not shown) to the feed assembly 10. Retaining tab(s) 38 or the like may be added to the feed window wall 30 to give the feed window 12 a snap-on mounting and retention function.

The feed window 12 and inner window insert 24 may be cost effectively manufactured with a high level of precision via injection molding.

The present invention has been demonstrated in detail with respect to a flat feed window surface 14 and flat inner window insert surface 28. Alternatively, the feed window surface 14 and a corresponding inner window insert surface 28 may be curved, for example to correspond to a curvature of the main reflector such that the reflected signal rays from the different areas of the antenna main reflector surface are each normal to the respective area of a curved feed window surface 14 and a corresponding curved inner window insert surface 28 according to the invention.

One skilled in the art will appreciate that the single feed window 12 according to the present invention eliminates multiple separate feed window(s) 12 and associated sealing surface(s) 34 previously applied to multiple feed reflector antennas. The multiple feeds covered by the present single feed window 12 may each operate with different frequency bands with maximized performance for selected feed(s) via application of the inner window insert 24. Aperture(s) 26 may be applied to the inner window insert 24 to prevent the presence of the inner window insert 24 from introducing further signal degradation to feeds operating at frequencies the inner window insert 24 is not positioned to dampen the feed window reflections of. Further, the multiple feeds covered by the single feed window 12 according to the invention may be closely spaced together, for narrow signal beam offset applications, without having multiple individual feed window wall(s) 30 interfering with the field views of different adjacent feeds.

| Table of Parts | |
|---|---|
| 10 | feed assembly |
| 12 | feed window |
| 14 | feed window surface |
| 16 | open end |
| 18 | Ka band feed |
| 20 | Ku band feed |
| 22 | launch edge |
| 24 | inner window insert |
| 26 | aperture |
| 28 | inner window insert surface |
| 29 | Ku band feed view window |
| 30 | feed window wall |
| 32 | shoulder |
| 34 | sealing surface |

-continued

| Table of Parts | |
|---|---|
| 36 | groove |
| 38 | retaining tab |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A feed window for a feed assembly having at least one primary feed operating at a primary frequency band and at least one secondary feed operating at a secondary frequency band, the feed window comprising:

a feed window sealing against the feed assembly, enclosing an open end of the primary feed(s) and the secondary feed(s);

the feed window having a feed window surface supported by and spaced away from the feed assembly by a feed window wall;

the feed window surface of the feed window generally parallel to a launch edge of the primary feed(s) and the secondary feed(s);

an inner window insert positioned between the feed window surface and the primary feed and the secondary feed;

the inner window insert having an inner window insert surface generally parallel to the feed window surface.

2. The assembly of claim 1, wherein the inner window insert surface is positioned a distance from the feed window surface corresponding to a multiple of one of a mid-band operating frequency wavelength of the primary frequency band and a mid-band operating frequency wavelength of the secondary frequency band.

3. The assembly of claim 2, wherein the multiple is one eighth wavelength.

4. The assembly of claim 1, wherein the launch edge(s) of one of the primary feed and the secondary feed are spaced away from the feed window surface, by a distance corresponding to a multiple of one of a mid-band operating frequency wavelength of the primary frequency band and a second multiple of a mid-band operating frequency wavelength of the secondary frequency band.

5. The assembly of claim 2, wherein the multiple is one quarter wavelength.

6. The assembly of claim 1, wherein the inner window insert has an insert aperture(s) corresponding to a feed view window of one of the primary feed(s) and the secondary feed(s).

7. The assembly of claim 1, wherein the insert is seated against a shoulder formed in the feed window wall.

8. The assembly of claim 1, further including a plurality of retaining tabs formed in the feed window wall; the retaining tabs operating to retain the feed window against the feed assembly.

9. The assembly of claim 1, wherein the primary frequency band is Ka band and the secondary frequency band is Ku band.

10. The assembly of claim 1, wherein the feed window and the inner window insert are each formed by injection molding of a dielectric material.

11. The assembly of claim 1, wherein the feed window surface and the inner window insert surface is flat.

12. The assembly of claim 1, wherein the feed window surface is curved.

13. The assembly of claim 1, wherein the inner window insert surface in the field of view of the primary feed is positioned a distance from the feed window surface corresponding to a multiple of a mid-band operating frequency wavelength of the primary frequency band; and the insert surface in the field of view of the secondary feed is positioned a distance from the feed window surface corresponding to a multiple of a mid-band operating frequency wavelength of the secondary frequency band;

the areas of the insert surface at different distances from the feed window surface separated from one another by a step in the inner window insert surface.

14. A feed window for a feed assembly having at least one primary feed operating at a primary frequency band and at least one secondary feed operating at a secondary frequency band, the feed window comprising:

a feed window sealing against the feed assembly, enclosing an open end of the primary feed(s) and the secondary feed(s);

the feed window having a feed window surface supported by and spaced away from the feed assembly by a feed window wall;

the feed window surface of the feed window generally parallel to a launch edge of the primary feed(s) and the secondary feed(s); and an inner window insert seated against a shoulder formed in the feed window wall, positioned between the feed window surface and both of the primary feed and the secondary feed;

the inner window insert having an inner window insert surface generally parallel to the feed window surface;

the inner window insert having an insert aperture(s) corresponding to a feed view window of one of the primary feed(s) and the secondary feed(s).

* * * * *